United States Patent [19]

Eley

[11] Patent Number: 4,901,045

[45] Date of Patent: Feb. 13, 1990

[54] SECONDARY CIRCUIT BREAKER FOR DISTRIBUTION TRANSFORMERS

[75] Inventor: E. R. Eley, Athens, Ga.

[73] Assignee: Westinghouse Electric Corp., Pittsburgh, Pa.

[21] Appl. No.: 325,760

[22] Filed: Mar. 20, 1989

[51] Int. Cl.[4] ..... H01H 73/48; H01H 71/16; H01H 61/08

[52] U.S. Cl. ..... 335/70; 335/27; 337/71; 337/140

[58] Field of Search ..... 337/140, 70, 71; 335/22, 27

[56] References Cited

U.S. PATENT DOCUMENTS

| | | | |
|---|---|---|---|
| 3,670,129 | 6/1972 | Cherry et al. | 200/166 |
| 3,674,962 | 7/1972 | Kroeger | 200/172 A |
| 3,676,815 | 7/1972 | Du Rocher | 337/140 |
| 3,961,481 | 6/1976 | Romanenko et al. | 60/531 |
| 4,000,480 | 12/1976 | Gray et al. | 335/129 |
| 4,028,513 | 6/1977 | Laubach | 200/144 |
| 4,044,215 | 8/1977 | Leibinger et al. | 200/318 |
| 4,128,750 | 12/1978 | Castonguay et al. | 200/308 |
| 4,168,417 | 9/1979 | Puetz et al. | 200/330 |
| 4,181,838 | 1/1980 | Neuser et al. | 200/153 LA |
| 4,205,293 | 5/1980 | Melton et al. | 337/140 |
| 4,275,370 | 6/1981 | Sims | 335/37 |
| 4,421,959 | 12/1983 | Chen et al. | 200/16 A |
| 4,427,862 | 1/1984 | Lin | 200/252 |
| 4,459,445 | 7/1984 | Hisatsune et al. | 200/144 R |
| 4,524,343 | 7/1985 | Morgan et al. | 337/140 |
| 4,538,039 | 8/1985 | Gotoh et al. | 200/144 B |
| 4,544,811 | 10/1985 | Brevick | 200/5 R |
| 4,616,206 | 10/1986 | Bridges et al. | 337/71 |
| 4,626,638 | 12/1986 | Samples et al. | 200/331 |

FOREIGN PATENT DOCUMENTS

| | | |
|---|---|---|
| 762048 | 9/1980 | U.S.S.R. . |
| 1443003 | 7/1976 | United Kingdom . |

*Primary Examiner*—H. Broome
*Attorney, Agent, or Firm*—B. R. Studebaker

[57] ABSTRACT

A circuit breaker having a fixed current contact (12,14), a movable current contact (16,18), a mechanism (20,22,54,66,68) for displacing the movable current contact (16,18) between a circuit closing position and a circuit opening position, and a latching member (32,34) disposed to cooperate with the mechanism (20,22,54,66,68) and movable in response to the magnitude of current flowing through the circuit to be controlled in order to cause the mechanism (20,22,54,66,68) to move the movable contact (16,18) in a manner to open the circuit when the magnitude of current flow exceeds a certain value, movement of the latching member (32,34) being controlled by a memory metal element (40,42) which is mechanically connected to the latching member (32,34) and electrically connected in the circuit to be heated by current flowing through the circuit to cause the latching member (32,34) to release the mechanism (20,22,54,66,68) when the current flowing through the circuit exceeds a given value for a selected period of time. The circuit breaker is further provided with a remotely located control unit (140–166) which is coupled to the circuit breaker mechanism (20,22,54,66,68) by a cable (78).

The circuit breaker is further provided with an emergency locking device (180,188) which is manually movable into a locking position for preventing the mechanism (20,22,54,66,68) from moving upon being released by the latching member (32,34).

17 Claims, 3 Drawing Sheets

SECONDARY CIRCUIT BREAKER FOR DISTRIBUTION TRANSFORMERS

BACKGROUND OF THE INVENTION

The present invention relates to circuit breakers, and particularly secondary circuit breakers for distribution transformers.

While there are many types of circuit breakers available for such systems, the available circuit breakers have relatively complex thermal tripping and manual actuating mechanisms. Moreover, while there are many conventional circuit breakers which can be reset to a higher thermal tripping temperature, existing breakers do not possess a simple mechanism which permits the thermal tripping function to be entirely disabled.

SUMMARY OF THE INVENTION

It is a primary object of the present invention to simplify the thermal tripping mechanism of such circuit breakers.

Another object of the invention is to provide a simple arrangement for manually operating such a circuit breaker from a location remote from the circuit breaker itself.

A further object of the invention is to provide a simple mechanism which enables the thermal tripping function of such a circuit breaker to be entirely disabled.

The above and other objects are achieved, according to the present invention, in a circuit breaker including a current conducting path, a fixed current contact and a movable current contact connected in the current path, a mechanism supporting the movable current contact for movement between a contact closing position in which the movable current contact is in contact with the fixed current contact to complete the current path and a contact opening position in which the movable current contact is separated from the fixed current contact to open the current path, latch means movable between a latching position for engaging the mechanism to enable the mechanism to be in the contact closing position and a release position for releasing the mechanism to allow the mechanism to move to the contact opening position, and latch actuating means coupled to the latch means for moving the latch means between the latching and release positions, by the improvement wherein the latch actuating means comprise: a memory metal element mechanically connected to the latch means and electrically connected in the current conducting path to be heated by current flowing through the path, the memory metal element being formed to place the latch means in the latching position when the current through the path is below a selected magnitude and to place the latch means in the release position when the current through the path is above the selected magnitude.

Objects according to the invention are further achieved by the provision, in a circuit breaker of the type described above, of biassing means for urging the mechanism into its contact closing position and circuit breaker control means disposed at a location remote from the current path, the mechanism and the latch means and movable between a circuit breaker opening position and a circuit breaker closing position; and a first flexible cable connected between the control means and the mechanism for moving the mechanism in response to movement of the control means such that movement of the control means to the circuit breaker opening position moves the mechanism to the contact opening position and movement of the control means to the circuit breaker closing position permits the mechanism to move, under the influence of the biassing means, into the contact closing position.

In further accordance with the invention, such a circuit breaker is provided with emergency locking means operatively associated with the mechanism and movable into a locking position for preventing the mechanism from moving to the contact opening position in response to movement of the latching means to the release position.

DESCRIPTION OF THE PREFERRED EMBODIMENTS

Figure 1:
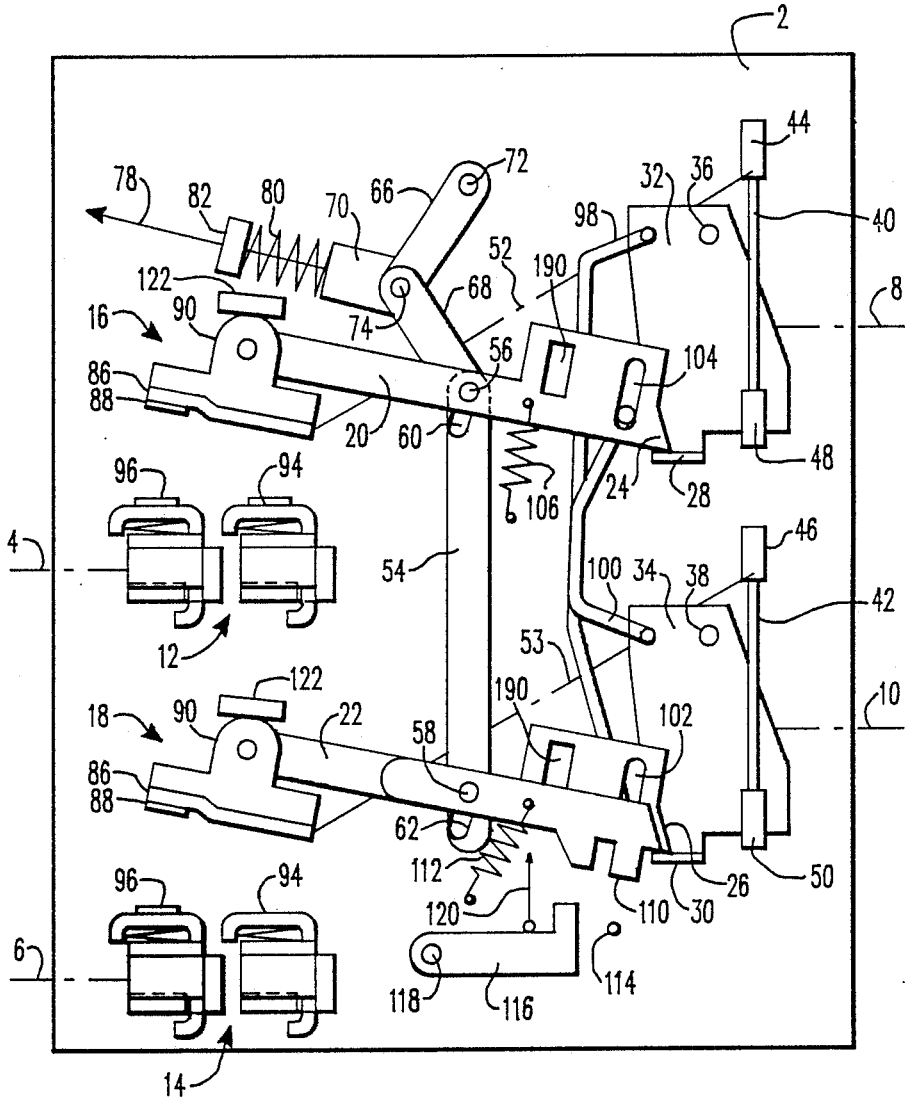
FIG. 1 is an elevational view of a preferred embodiment of a circuit breaker device according to the present invention.

FIG. 1 shows the basic components of a circuit breaker embodying the present invention mounted on a molded plastic base 2, the circuit breaker providing two independent load current paths, each defined by a respective entry lead 4, 6 and a respective exit lead 8, 10. Each current path further includes a stationary contact assembly 12, 14 and a respective movable contact assembly 16, 18.

Each movable contact assembly 16, 18 is pivotally supported at one end of a respective contact arm 20, 22. The opposite end of each arm 20, 22 is formed to contact a latching finger 24, 26, each latching finger normally being engaged by a respective latch 28, 30, each forming part of a respective latch arm 32, 34 each pivotally mounted on base 2 via a respective pivot pin 36, 38.

According to a particular feature of the present invention, movement of each latch arm 32, 34 is effected by a respective memory metal actuator 40, 42, each mounted at one end to a respective fixed support 44, 46 secured to base 2 and at the other end to a movable support 48, 50 fastened to respective ones of latch arms 32, 34.

Each fixed support 44, 46 is connected to a respective movable contact 16, 18 by a respective current lead 52, 53 and each exit lead 8, 10 is connected to a respective one of latch arms 32, 34 and the current path between each fixed support 44, 46 and its associated latch arm 32, 36 is constituted by the respective actuator 40, 42.

Each actuator 40, 42 is constructed and treated to be in the configuration illustrated in FIG. 1 while at normal operating temperature but to be deflected, upon being heated to a higher, preselected temperature, in a manner to pivot its respective latch arm 32, 34 in a counter-clockwise direction, thereby releasing the associated latching finger 24, 26.

Because of the inherent properties of memory metals, actuator 40, 42 will directly generate a force sufficient to pivot the associated latch arm 32, 34 by the amount required to release latching finger 24, 26. Thus, the complicated lever and latch arrangements required with bimetal actuators can be eliminated.

While the illustrated actuators 40, 42 are in the form of cantilever bars, actuators according to the present invention could alternatively take the form of torsion bars or coil springs, or could have other configurations, it only being required that the actuator be configured and treated to pivot each latch arm 32, 34 by the required amount when heated to a given temperature.

Moreover, actuators made of a memory metal will have a much lower resistance than conventional bimetal actuators, so that circuit breakers according to the present invention will have lower power losses than conventional breakers.

Contact arms 20, 22 are pivotally mounted at opposite ends of a connecting link 54 by means of pivot pins 56 and 58 each passing through circular passages in arms 20 and 22 and link 54. Pins 56 and 58 are guided in guide slots 60 and 62 provided on base 2.

Movement of connecting link 54 is controlled by a toggle mechanism composed of an upper toggle link 66, a lower toggle link 68 and a cable connector 70. The upper end of toggle link 66 is pivoted to base 2 by a pivot pin 72, while the lower end of link 66, the upper end of link 68 and connector 70 are connected together by a pivot pin 74 and the lower end of link 68 is pivotally connected to pin 56.

Movement of the toggle mechanism is controlled by a toggle operating cable 78 secured to connector 70 and a compression spring 80 interposed between connector 70 and an abutment member 82 which is secured to base 2. In view of the biassing action performed by spring 80, cable 78 need only perform a pulling movement and therefore need not be enclosed in a restraining sheath that would have to be fastened at booth ends.

Each movable contact 16, 18 is composed of a copper contact member 86 and a refractory contact member 88. Each contact 86 is supported by an insulator 90 carried by a respective one of arms 20 and 22. Each copper contact 86 is connected to a respective one of current leads 52 and 53.

Each stationary contact assembly 12, 14 is composed of a load current contact 94 and an arcing contact 96 provided with a refractory contact member. Each of contacts 94 and 96 is mounted in an insulating support secured to base 2 in such a manner as to be movable over a short distance in the direction toward and away from its associated movable contact assembly 16, 18, each of contacts 94 and 96 being provided with a biasing spring urging that contact in the direction toward its associated movable contact assembly. In addition, contacts 94 and 96 are constructed to permit each arcing contact 96 to be movable over a slightly greater travel path than its associated load current contact 94. When the circuit breaker is closed, each copper contact member 86 contacts its associated load current contact 94 and each refractory contact member 88 contacts the refractory member of its associated arcing contact 96. During opening movement of each movable contact assembly 16, 18, contact between copper contact member 86 and load current contact 94 will be broken first so that a current flow of reduced amplitude can continue to flow between refractory contact member 88 and arcing contact 96. When contact therebetween is subsequently broken, the resulting arc occurs between the refractory members and thereby causes minimal damage.

In order to assure that the contacts associated with both current paths will open at the same, the contact arm 20, 22 associated with each current path is coupled to the latch arm 32, 34 associated with the other current path by a respective one of two trip links 98, 100. Trip link 98 is pivotally connected at one end to latch arm 32 and at its other end engages slidably in a slot 102 provided in contact arm 22. Correspondingly, trip link 100 is pivotally connected at one end to latch arm 34 and engages via its other end in a slot 104 formed in contact arm 20 and identical in configuration to slot 102.

Each contact arm 20, 22 is biased in a clockwise direction relative to its associated link 56, 58 by a bias spring 106 secured to base 2, only the spring 106 associated with contact arm 20 being shown.

In addition, a signal arm 110 is pivotally mounted on pivot pin 58 and is biased in a clockwise direction by a spring 112 fastened to base 2. Signal arm 110 is associated with a signal contact 114 in such a manner that a trip signal is produced when arm 110 strikes signal contact 114. Signal arm 110 is provided with a latching finger which is similar in shape to finger 26. However, as shown, finger 26 projects slightly beyond the latching finger on signal arm 110.

Signal arm 110 is associated with a reset arm 116 which is pivotally mounted to base 2 at a pivot pin 118 and is spring biased into the position illustrated by a suitable return spring (not shown). Reset arm 116 is connected to a signal reset cable 120 which can be actuated to pivot arm 116 in a counter-clockwise direction against an actuating finger of signal arm 110.

The circuit breaker is shown FIG. 1 in its manually open position. In order to close the circuit breaker, the tension on cable 78 is released to permit connector 70 to move to the right, under the influence of spring 80, to a position at which toggle links 66 and 68 lie in a straight line with connecting link 54. During this movement, link 54 is displaced downwardly, with pins 56 and 58 moving downwardly in guide slots 60 and 62, respectively. This brings movable contact assemblies 16 and 18 into electrical contact with stationary contact assemblies 12 and 14.

At this time, the circuit breaker is closed and can be opened either manually or in response to heating of either one of actuators 40 and 42, due to a current overload in either current path. If, for example, such an overcurrent occurs in the path between entry lead 4 and exit lead 8, actuator 40 will be heated sufficiently to pivot latch arm 32 counter-clockwise until latching finger 24 is released. Then, under the influence of spring 106, contact arm 20 pivots clockwise causing the connection between stationary contact assembly 12 and movable contact assembly 16 to be broken, in the manner described above.

Near the end of travel of contact arm 20, the upper end of trip link 100 reaches the upper end of slot 104, after which further pivotal movement of contact arm 20 produces a downward movement of link 100, which causes latch arm 34 to pivot counter-clockwise, thereby releasing both latching finger 26 and the latching finger of signal arm 110. Thus, connection between stationary contact assembly 14 and movable contact assembly 18 is broken and signal arm 110 comes into contact with signal contact 114. During this opening movement, insulators 90 come into contact with associated abutments 122.

The circuit breaker can be reset after actuators 40 and 42 have cooled sufficiently to return latch arms 32 and 34 to their latching positions, as shown in FIG. 1. Then, cable 78 is pulled to the left to bring the toggle mechanism into the position shown in FIG. 1. During this movement, while insulators 90 remain in contact with abutments 122, latching fingers 24 and 26 move past latches 28 and 30, performing a camming action which pivots latch arms 32 and 34 slightly in the clockwise direction against the restoring force of actuators 40 and 42, until latch arms 24 and 26 move past latches 28 and 30, after which latch arms 32 and 34 pivot back to bring latches 28 and 30 to their latching position.

In order to reset signal arm 110, cable 120 is pulled upwardly to pivot reset arm 116 in a direction to rotate signal arm 110 back into the position shown in FIG. 1, during which movement, the right-hand end of signal arm 110 moves past latch 130. While this movement will pivot latch arm 34 through a small distance in the counter-clockwise direction, this movement will not be sufficient to release latching finger 26 because that latching finger projects slightly beyond the free end of signal arm 110.

Then, cable 78 is displaced to the right, causing the toggle mechanism to move link 54 downwardly, thus re-establishing the connection between movable contact assemblies 16 and 18 and stationary contact assemblies 12 and 14. At the same time, cable 120 is permitted to move downwardly in order to return reset arm to its inactive position, as shown in FIG. 1.

Manual opening of the switch is effected simply by moving cable 78 to the left in order to bring the toggle mechanism and link 54 into the position shown in FIG. 1.

Figure 2:
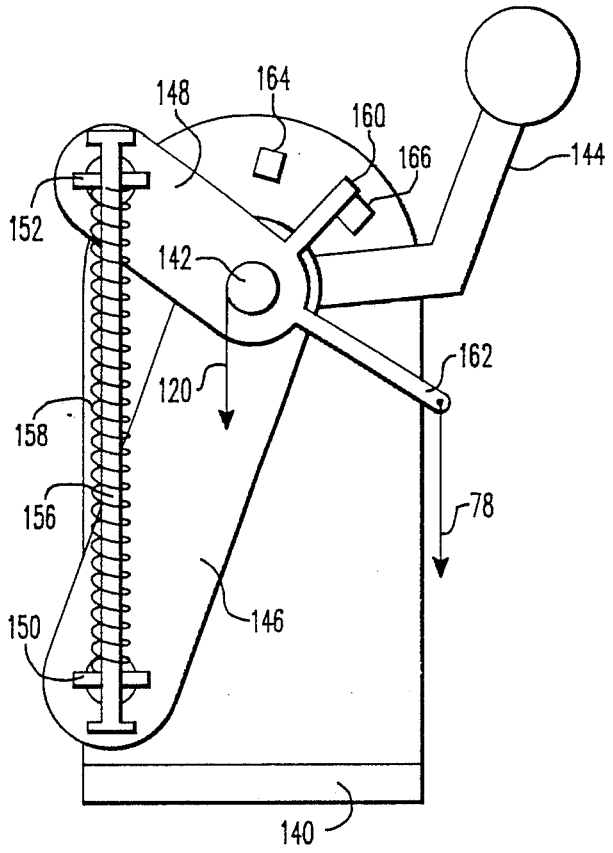
FIG. 2 is a side elevational view of a preferred embodiment of a remote control device for the circuit breaker of FIG. 1.

One preferred embodiment of a remote operating mechanism according to the present invention is illustrated in FIG. 2. The operating mechanism is carried by a base 140 in which a shaft 142 is pivotally mounted. Shaft 142 is fixed to a manual operating handle 144 and a first control arm 146. A second control arm 148 is mounted on shaft 142 in a manner to be pivotable relative to shaft 142. Each of arms 146 and 148 carries a respective support plate 150, 152 which is pivotally mounted in an opening provided at the free end of the respective control arm 146, 148.

A rod 156 extends between plates 150 and 152, being slidably mounted in an opening provided in each support plate, and a compression spring 158 is disposed around rod 156 and compressed between plates 150 and 152.

Cable 120 is secured to shaft 142 and extends thereabout in the manner illustrated so that when shaft 142 is rotated in the clockwise direction, cable 120 will be pulled upwardly.

Arm 148 is provided with first and second projecting members and 160 and 162. Projecting member 160 cooperates with abutment members 164 and 166 to limit the range of pivotal movement of arm 148. Second projecting member 162 is secured, at its free end, to the end of cable 78 remote from cable connector 70 (FIG. 1).

In the position shown in FIG. 2, the operating mechanism maintains the circuit breaker in its closed position in which, referring to FIG. 1, link 54 is in its lower most position and reset arm 116 is in its retracted position.

The operating mechanism shown in FIG. 2 is an over-center type mechanism in that when arm 146 is pivoted clockwise to a point just past the point at which arms 146 and 148 come into alignment, spring 158 will act to pivot arm 148 in the Counter-clockwise direction, thus drawing cable 78 upwardly and moving projecting member 160 into contact with abutment member 164.

In FIG. 2, the operating mechanism is shown in its circuit breaker closing position. In order to manually open the circuit breaker, handle 144 is manually moved in the clockwise direction until arm 146 moves past arm 148. During this movement, cable 120 is pulled upwardly in order to pivot reset arm 116 in the counter-clockwise direction from the position shown into a position where it has moved past the portion of signal arm 110 with which it would engage in order to reset signal arm 110. When arm 146 moves past arms 148, arm 148 is pivoted by the action of spring 158 in order to pull cable 78 upwardly and thus bring the toggle mechanism to the position shown in FIG. 1.

Subsequent closing of the circuit breaker is effected by moving handle 144 back to the position shown in FIG. 2.

If a condition should occur in which the circuit breaker remains closed, but signal arms 110 has tripped, the signal arm can be reset by moving handle 144 in the clockwise direction over only a portion of its travel path to a point at which arm 146 does not come into alignment with arm 148. Under these conditions, cable 120 is moved sufficiently to cause reset arm 116 to return signal arm 110 to the position shown in FIG. 1, without displacing cable 78.

After the circuit breaker has been thermally tripped, and latch arms 32 and 34 have returned to the latching positions shown in FIG. 1, the circuit breaker can be reset simply by moving handle 144 in the clockwise direction relative to that shown in FIG. 2 to the manual opening position, and then moving handle 144 back to the circuit breaker closing position. Then, signal arm 110 can be reset in the manner described above.

Figure 3:
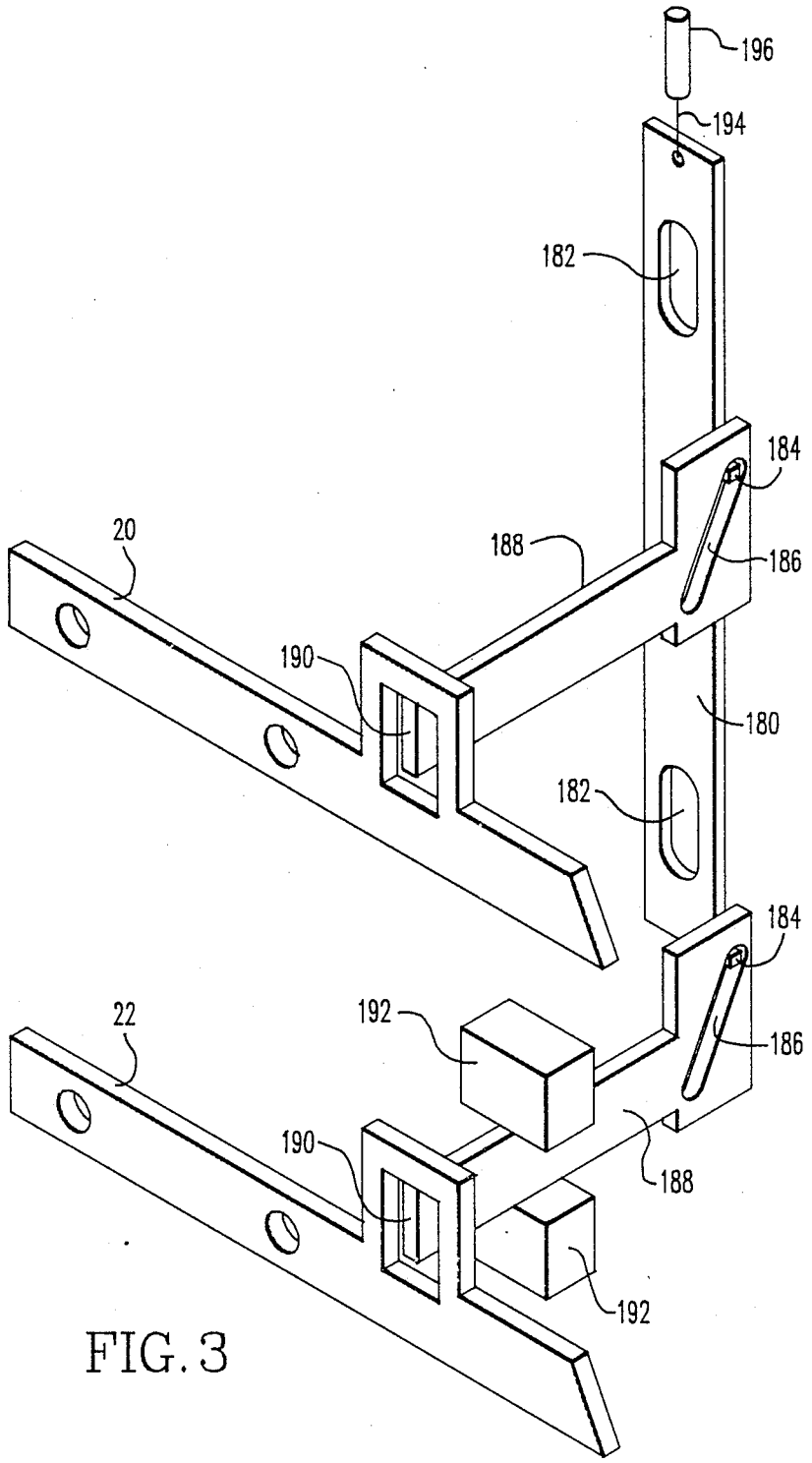
FIG. 3 is a perspective view of an emergency locking mechanism according to the invention, for use with the circuit breaker shown in FIG. 1.

According to a further feature of the present invention, the circuit breaker shown in FIG. 1 can be equipped with an emergency control mechanism which can be positioned to prevent the circuit breaker from tripping thermally, while permitting it to continue to be manually opened. A preferred embodiment of such a mechanism is shown in FIG. 3 in position relative to contact arms 20 and 22. The emergency control mechanism includes an emergency control slide 180 provided with guide slots 182. Slide 180 will be mounted outside of the circuit breaker case, for example behind base 2 of FIG. 1 and will be supported by, for example, rivets secured to base 2 and extending through slots 182, thereby limiting slide 180 to movement only in the direction of its length. Slide 180 carries two actuating pins 184 each engaging in an inclined slot 186 in a respective one of two emergency control arms 188.

Arms 188 extend through openings in base 2 (not shown) to engage in slots 190 in arms 20 and 22. Each control arm 188 is disposed between two guide members 192 (shown only for the lower control arm) secured to base 2 in order to permit each control arm 188 to move only in a direction perpendicular to the direction of movement of control slide 180.

Movement of control slide 180 is controlled by a cable 194 mounted in a sheath 196 that is also secured to base 2 so that cable 194 can be employed to displace control slide 180 in either direction parallel to its length.

In the position shown in FIG. 3, control arms 188 engage in slots 190 to prevent thermal tripping of the circuit breaker. Downward movement of control slide 180 causes control arms 188 to retract from slots 190, thus permitting normal operation of the circuit breaker.

The operating end of cable 194 can remain at the location of the circuit breaker or can be extended to the remote location of the operating mechanism shown in FIG. 2.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

WHAT IS CLAIMED:

1. In a circuit breaker including a current conducting path, a fixed current contact and a movable current contact connected in the current path, a mechanism supporting the movable current contact for movement between a contact closing position in which the movable current contact is in contact with the fixed current contact to complete the current path and a contact opening position in which the movable current contact is separated from the fixed current contact to open the current path, latch means movable between a latching position for engaging the mechanism to enable the mechanism to be in the contact closing position and a release position for releasing the mechanism to allow the mechanism to move to the contact opening position, and latch actuating means coupled to the latch means for moving the latch means between the latching and release positions, the improvement wherein said latch actuating means comprise: a memory metal element mechanically connected to said latch means and electrically connected in said current conducting path to be heated by current flowing through said path, said memory metal element being formed to place said latch means in the latching position when the current through said path is below a selected magnitude and to place said latch means in the release position when the current through said path is above the selected magnitude.

2. A circuit breaker as defined in claim 1 further comprising: circuit breaker control means disposed at a location remote from said current path, said mechanism and said latch means and movable between a circuit breaker opening position and a circuit breaker closing position; and a first flexible cable connected between said control means and said mechanism for moving said mechanism in response to movement of said control means such that movement of said control means to said circuit breaker opening position moves said mechanism to said contact opening position and movement of said control means to said circuit breaker closing position moves said mechanism to said contact closing position.

3. A circuit breaker as defined in claim 2 further comprising: latch release signalling means mounted to be held in a retracted position by said latch means when said latch means are in said latching position and movable into a signalling position in response to movement of said latch means to said release position; reset means mounted for movement to a resetting position for moving said latch release signalling means to said retracted position; and a second flexible cable connected between said control means and said reset means, and wherein said control means are further movable into a reset position for moving said reset means to said resetting position.

4. A circuit breaker as defined in claim 3 wherein said control means comprise a manual actuating member movable over a path having a first end position for placing said control means in said circuit breaker closing position and a second end position for placing said control means in said circuit breaker opening position, said manual actuating member being movable from said first end position to an intermediate position for moving said control means to said reset position while maintaining said mechanism in said contact closing position.

5. A circuit breaker as defined in claim 4 wherein said control means comprise a first member fixed to said manual actuating member and coupled to said second cable, and a second member mounted for movement in response to movement of said first member and coupled to said first cable.

6. A circuit breaker as defined in claim 5 further comprising emergency locking means operatively associated with said mechanism and movable into a locking position for preventing said mechanism from moving to said contact opening position in response to movement of said latching means to said release position.

7. A circuit breaker as defined in claim 6 wherein said emergency locking means are manually movable between said locking position and an inactive position in which said emergency locking means do not influence movement of said mechanism.

8. In a circuit breaker assembly including a circuit breaker unit composed of a fixed current contact and a movable current contact connected in a current path, a mechanism supporting the movable current contact for movement between a contact closing position in which the movable current contact is in contact with the fixed current contact to complete the current path and a contact opening position in which the movable current contact is separated from the fixed current contact to open the current path, latch means movable between a latching position for engaging the mechanism to enable the mechanism to be in contact closing position and a release position for releasing the mechanism to allow the mechanism to move to the contact opening position, and latch actuating means coupled to the latch means for moving the latch means between the latching and release positions, the improvement wherein said circuit breaker unit further comprises biassing means connected to urge said mechanism into said contact closing position, and said assembly further comprises: circuit breaker control means disposed at a location remote from circuit breaker unit and movable between a circuit breaker opening position and a circuit breaker closing position; and a first flexible cable connected between said control means and said mechanism for moving said mechanism in response to movement of said control means such that movement of said control means to said circuit breaker opening position moves said mechanism to said contact opening position and movement of said control means to said circuit breaker closing position permits said mechanism to move, under the influence of said biassing means, into said contact closing position.

9. A circuit breaker as defined in claim 8 further comprising: latch release signalling means mounted to be held in a retracted position by said latch means when said latch means are in said latching position and movable into a signalling position in response to movement of said latch means to said release position; reset means mounted for movement to a resetting position for moving said latch release signalling means to said retracted position; and a second flexible cable connected between said control means and said reset means, and wherein said control means are further movable into a reset position for moving said reset means to said resetting position.

10. A circuit breaker as defined in claim 9 wherein said control means comprise a manual actuating member movable over a path having a first end position for placing said control means in said circuit breaker closing position and a second end position for placing said control means in said circuit breaker opening position, said manual actuating member being movable from said first end position to an intermediate position for moving said control means to said reset position while maintaining said mechanism in said contact closing position.

11. A circuit breaker as defined in claim 10 wherein said control means comprise a first member fixed to said manual actuating member and coupled to said second cable, and a second member mounted for movement in response to movement of said first member and coupled to said first cable.

12. A circuit breaker as defined in claim 11 further comprising emergency locking means operatively associated with said mechanism and movable into a locking position for preventing said mechanism from moving to said contact opening position in response to movement of said latching means to said release position.

13. A circuit breaker as defined in claim 12 wherein said emergency locking means are manually movable between said locking position and an inactive position in which said emergency locking means do not influence movement of said mechanism.

14. A circuit breaker as defined in claim 1 further comprising emergency locking means operatively associated with said mechanism and movable into a locking position for preventing said mechanism from moving to said contact opening position in response to movement of said latching means to said release position.

15. A circuit breaker as defined in claim 14 wherein said emergency locking means are manually movable between said locking position and an inactive position in which said emergency locking means do not influence movement of said mechanism.

16. In a circuit breaker including a current conducting path, a fixed current contact and a movable current contact connected in the current path, a mechanism supporting the movable current contact for movement between a contact closing position in which the movable current contact is in contact with the fixed current contact to complete the current path and a contact opening position in which the movable current contact is separated from the fixed current contact to open the current path, latch means movable between a latching position for engaging the mechanism to enable the mechanism to be in contact closing position and a release position for releasing the mechanism to allow the mechanism to move to the contact opening position, and latch actuating means coupled to the latch means for moving the latch means between the latching and release positions, the improvement comprising emergency locking means operatively associated with said mechanism and movable into a locking position for preventing said mechanism from moving to said contact opening position in response to movement of said latching means to said release position.

17. A circuit breaker as defined in claim 16 wherein said emergency locking means are manually movable between said locking position and an inactive position in which said emergency locking means do not influence movement of said mechanism.

* * * * *